US007797869B2

(12) United States Patent
Tollis et al.

(10) Patent No.: US 7,797,869 B2
(45) Date of Patent: Sep. 21, 2010

(54) MULTI-SECTION DISPLAY AND UTILITY STANCHION

(76) Inventors: David R. Tollis, 6416 Orchard Oriole La., Bradenton, FL (US) 34202; Lisa Fitzgerald, 8337 Silo Ct., Sarasota, FL (US) 34240

( * ) Notice: Subject to any disclaimer, the term of this patent is extended or adjusted under 35 U.S.C. 154(b) by 858 days.

(21) Appl. No.: 11/514,042

(22) Filed: Aug. 31, 2006

(65) Prior Publication Data

US 2008/0016736 A1 Jan. 24, 2008

Related U.S. Application Data

(63) Continuation-in-part of application No. 11/483,509, filed on Jul. 10, 2006, now Pat. No. 7,578,087.

(51) Int. Cl.
*G09F 15/00* (2006.01)

(52) U.S. Cl. ..... 40/610; 40/607.09; 40/607.05; 40/607.04; 40/606.19; 248/156

(58) Field of Classification Search ..... 40/607.05, 40/607.06, 607.09, 610; 211/194, 188; 248/156, 248/127, 158–159, 176.1
See application file for complete search history.

(56) References Cited

U.S. PATENT DOCUMENTS

| | | | | |
|---|---|---|---|---|
| 967,490 | A * | 8/1910 | Bell | 81/23 |
| 1,502,137 | A | 7/1924 | Foreest et al. | |
| 2,306,613 | A | 12/1942 | Chesley | |
| 2,423,532 | A | 7/1947 | Travis | |
| 3,037,617 | A | 6/1962 | Collin | |
| 3,074,203 | A * | 1/1963 | Paksy | 446/120 |
| 4,303,154 | A | 12/1981 | Hicks | |
| 4,357,772 | A * | 11/1982 | Amick et al. | 40/605 |
| 4,524,533 | A * | 6/1985 | Still, Jr. | 40/607.06 |
| 4,821,440 | A | 4/1989 | Dunn | |
| 5,529,173 | A | 6/1996 | Salacuse | |
| 5,623,778 | A | 4/1997 | Dunn | |
| 5,664,851 | A | 9/1997 | Dunn | |
| 5,800,027 | A | 9/1998 | Dunn | |
| 6,070,744 | A | 6/2000 | Levinson et al. | |
| D430,216 | S | 8/2000 | Dunn | |
| 6,618,974 | B2 | 9/2003 | Szalay | |
| 6,793,070 | B2 | 9/2004 | Dye | |
| 7,055,272 | B2 | 6/2006 | Tollis | |
| 2006/0080876 | A1 * | 4/2006 | Carter | 40/607.09 |
| 2006/0185203 | A1 * | 8/2006 | Bittle et al. | 40/541 |
| 2006/0185206 | A1 * | 8/2006 | Du Bose | 40/610 |

* cited by examiner

*Primary Examiner*—Cassandra Davis
(74) *Attorney, Agent, or Firm*—Charles J. Prescott

(57) ABSTRACT

A preferably weather resistant multi-section upright stanchion assembly for a construction site document storage apparatus, a real estate display sign and the like. The stanchion assembly includes a plurality of elongated substantially similar stanchion sections and a ground-engaging tip. Each stanchion section includes an elongated body having a hollow first end thereof and a second end thereof sized for slidable, releasable, lockable engagement into said first end of the next adjacent stanchion section to facilitate ease of height adjustment of the stanchion assembly. The stanchion assembly releasably connects at one end into a mating support cavity formed between the front and back panels of the inner frame of the storage apparatus. A single or two spaced upright stanchion assemblies support two horizontal spaced display panel support arms which, in turn, support a preferably multi-panel display sign. A ground-engaging tip connected at a lower end of each stanchion assembly supports the storage apparatus or display sign in an upright position.

2 Claims, 15 Drawing Sheets

MULTI-SECTION DISPLAY AND UTILITY STANCHION

CROSS-REFERENCE TO RELATED APPLICATIONS

This is a continuation in part of patent application Ser. No. 11/483,509 filed Jul. 10, 2006.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to utility and display apparatus and more particularly to a weather resistant multi-section stanchion support structure supporting a display and utility apparatus at buildings, homes or construction sites.

2. Description of Related Art

Documents related to a home or building construction site such as building permits and drawings must be kept in a weather resistant storage apparatus at each such construction site. Construction site storage apparatus are typically fastened to a tree or to an upright wooden board member which is driven into the ground. Inspectors and contractors routinely place documents into these storage apparatus and remove them therefrom as required during construction. An inspector may visit a construction site numerous times and require access to the building construction drawings while the public at large is placed on notice as to the details of the construction as set forth in the building permit which is also stored within the document storage apparatus.

Several environmental restrictions or requirements are placed upon such construction site document storage apparatus, namely the wear and tear they must undergo at a construction site and their weather-tight design structure required to insure that the documents placed therewithin are not ruined with rainwater intrusion or blown from the storage apparatus should the openable feature thereof become disengaged during high wind conditions.

Gary Dunn has brought his inventiveness to bear as set forth in numerous patents issued to him. One such disclosure in U.S. Pat. No. 4,821,440 teaches such a construction site document disclosure apparatus having a back frame having a U-shaped curl at each outer edge of its top and bottom sides and a four-sided hinged cover which engages in flush fashion therewith to prevent water access into the interior of the apparatus. In U.S. Pat. No. 5,623,778, Dunn teaches a weatherized posting board assembly having a back frame and a front cover of unitary construction for the posting and removal of documents to be posted therein. In U.S. Pat. No. 5,664,851, Dunn there teaches another document display case for displaying construction permits and the like, the weather resistant case having a base member and a door hinged thereto and also providing a tack board mounted to the rear wall of the base member for supporting displayed documents. A transparent window in the door permits viewing of the documents directly.

Dunn further teaches in U.S. Pat. No. 5,800,027 a brochure display case for displaying and dispensing promotional literature, business cards and the like at unattended sites. In U.S. Pat. No. 6,012,786, Dunn has disclosed still another construction site display and storage case which is weather resistant and ventilated. A unique notch and slot structure is adapted for attachment of the device to either an upright or a horizontal board support member. The design features of a permit box are also taught by Dunn in U.S. Design 430,216.

Other related prior art known to applicant are taught in U.S. Pat. No. 5,529,173 by Salacuse teaching a convertible container and frame having two panels hingedly connected together and, when open, providing a double length framed area. Levinson, in U.S. Pat. No. 6,070,744 teaches another display unit for attachment to a supporting surface and including downwardly extending document display holder panels pivotally attached to a support member. In U.S. Pat. No. 6,618,974, Szalay teaches a message display apparatus including a frame with spaced side rails which slidably receive a pair of covers, one of which is visibly clear for viewing documents and protecting them from weather conditions.

U.S. Pat. No. 7,055,272 provides a weather resistant construction site document storage apparatus having uniquely configured inner document frame and outer enclosure aspects which slidably engage vertically one to another to provide access for placement and removal of documents when the outer enclosure is in a temporarily fixed upward position. The inner document frame is attachable to either a tree or other timber support member or to a uniquely configured elongated T-shaped support member which is securely engageable into the ground. A separate front document enclosure attachable to the front panel of the outer enclosure is also provided and is preferred.

Real estate display signs also require a weather-resistant support structure for long-term use and reusability. Typically, these support members are fabricated of angle iron or wooden posts.

The present invention provides a structurally distinct and more economically manufacturable and durable multi-segment display and utility stanchion for use with construction site document storage apparatus, real estate display signs, and the like.

BRIEF SUMMARY OF THE INVENTION

This invention is directed to a weather resistant multi-segment utility and display stanchion for supporting construction site document storage apparatus, a real estate display sign and the like. The stanchion assembly includes a plurality of elongated substantially similar stanchion sections and a ground-engaging tip. Each stanchion section includes an elongated body having a hollow first end thereof and a second end thereof sized for slidable, releasable, lockable engagement into said first end of the next adjacent stanchion section to facilitate ease of height adjustment of the stanchion assembly. The stanchion assembly releasably connects at one end into a mating support cavity formed between the front and back panels of the inner frame of the storage apparatus. A single or two spaced upright stanchion assemblies support two horizontal spaced display panel support arms which, in turn, support a preferably multi-panel display sign. A ground-engaging tip connected at a lower end of each stanchion assembly supports the storage apparatus or display sign in an upright position.

It is an object of this invention to provide a weather resistant multi-segment utility stanchion assembly for use, and in combination with, a construction site permit and document storage apparatus attachable to the upright stanchion assembly at a construction site and the like.

Yet further object of this invention is to provide a multi-segment stanchion assembly for use, and in combination with, a real estate display sign and the like.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
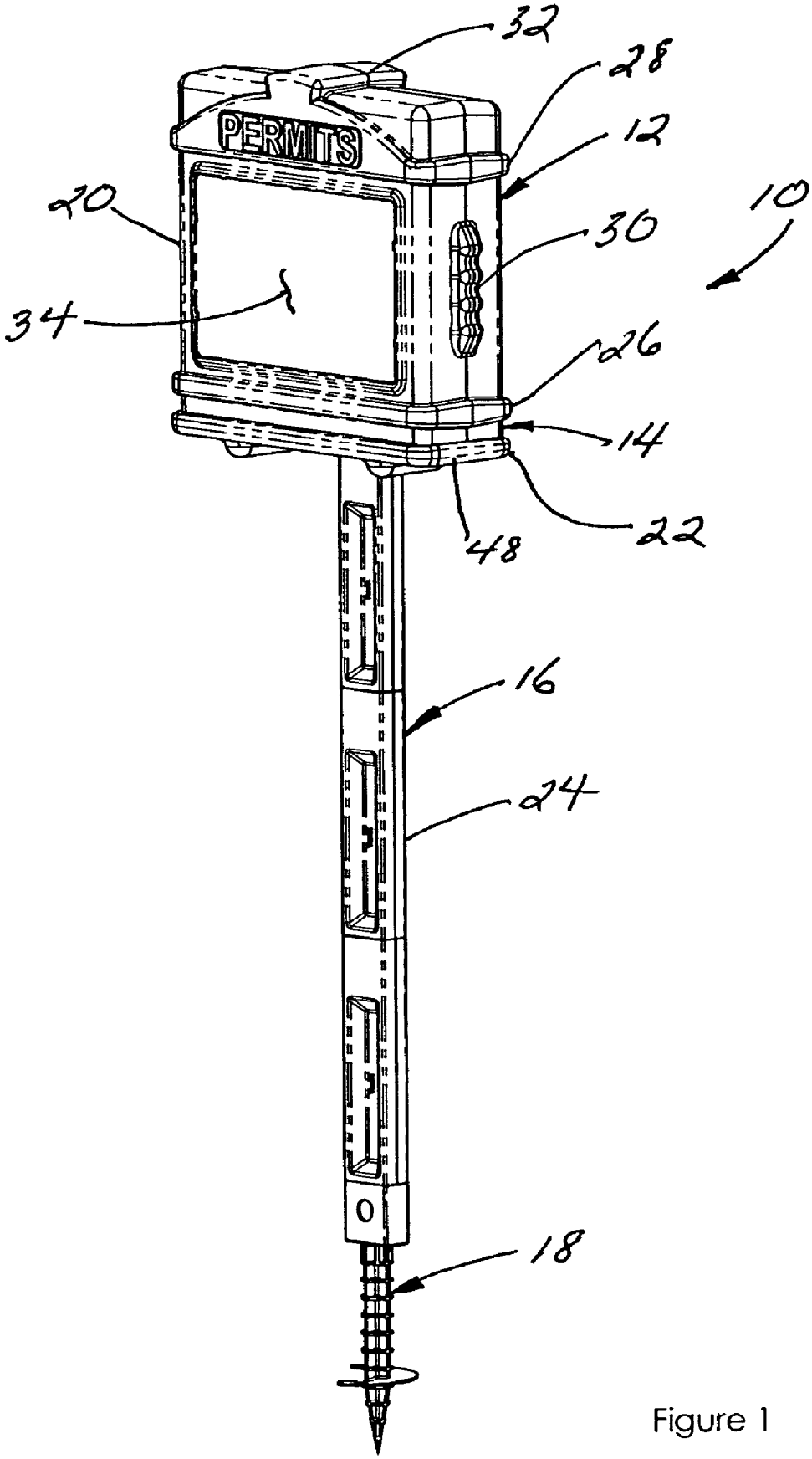
FIG. 1 is a perspective view of one embodiment of the invention.
Figure 2:
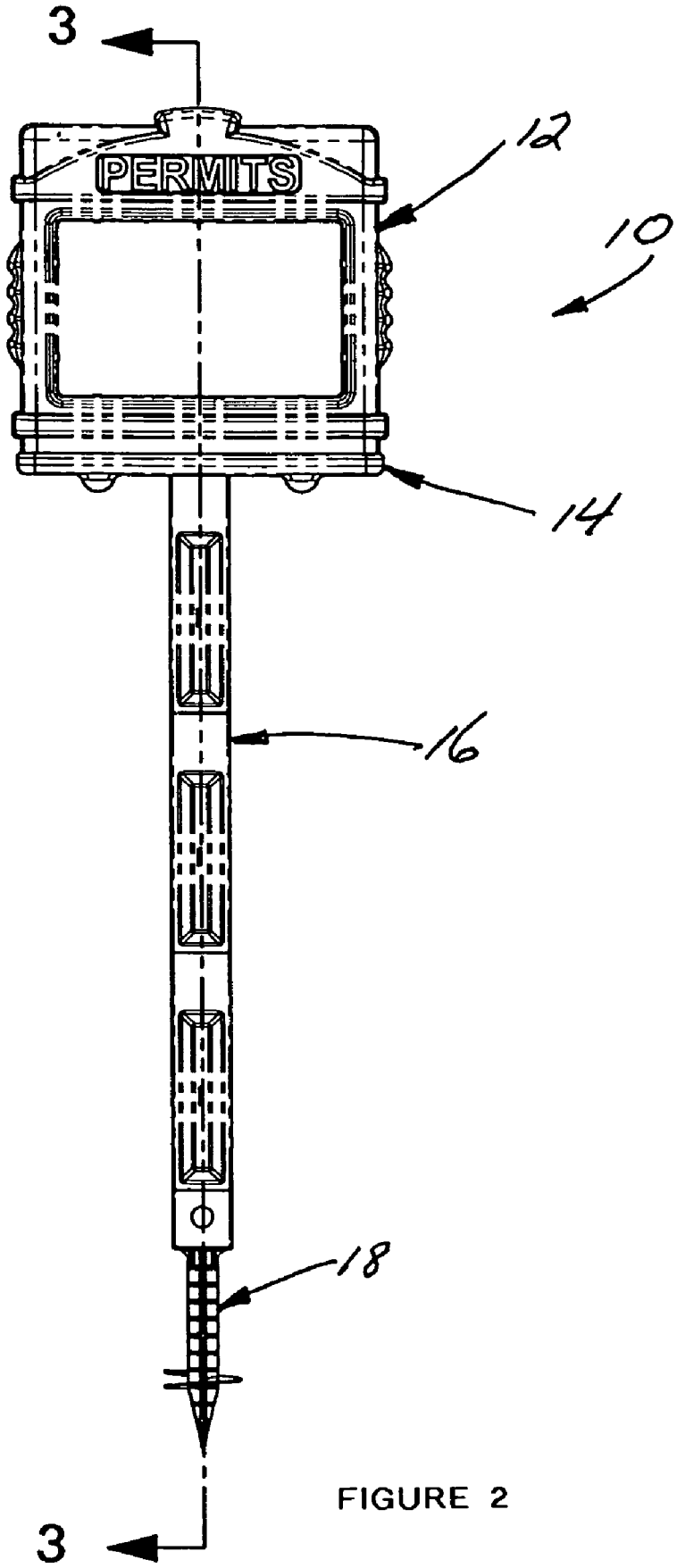
FIG. 2 is a front elevation view of FIG. 1.
Figure 3:
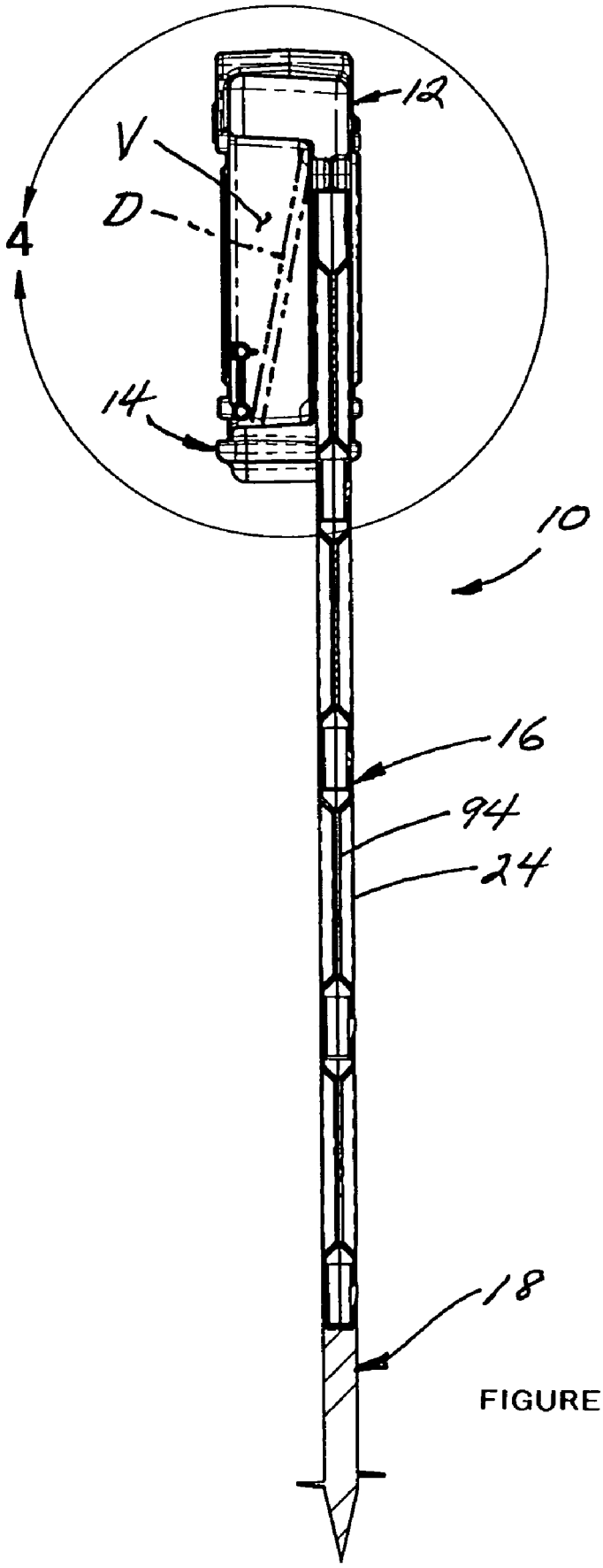
FIG. 3 is a section view in the direction of arrows 4-4 in FIG. 3.

Referring now to the drawings, one aspect of the invention is there shown generally at numeral 10. A document storage apparatus 10 preferably includes an outer enclosure 12, an inner document-receiving frame 14, an upright segmented stanchion assembly 16 with a ground engaging tip 18. The outer enclosure 12 is preferably formed of thin thermoplastic material utilizing blow mold manufacturing techniques. Likewise, the inner frame 14 is also formed of thin walled thermoplastic material utilizing blow mold manufacturing techniques. The net result is that the outer housing 20 and the inner housing 22 are extremely light and economical to manufacture and weather-resistant while maintaining the necessary strength and dimensional consistency to support the functionality of the invention as will be described herebelow.

Figures 5, 6:
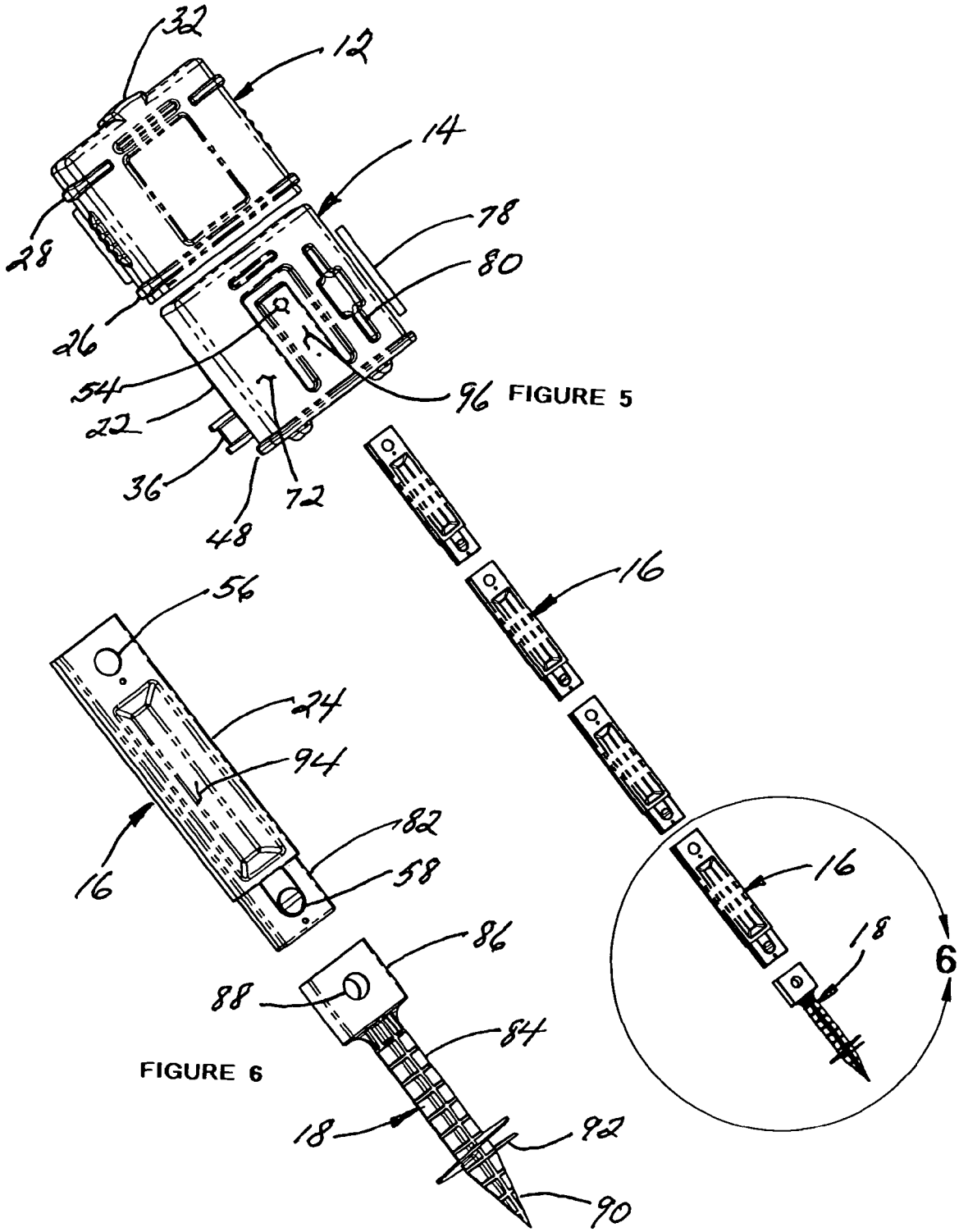
FIG. 5 is an exploded rear perspective view of the invention of FIG. 1.
FIG. 6 is an enlargement of area 5 in FIG. 5.
Figure 7:
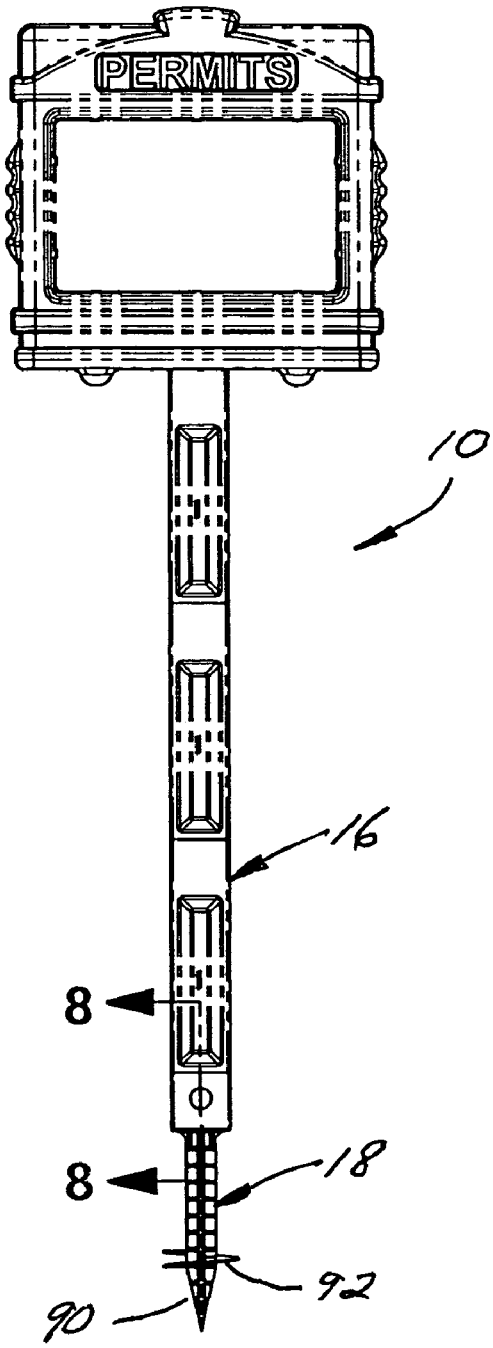
FIG. 7 is another front elevation view of the invention of FIG. 1.
Figure 8:
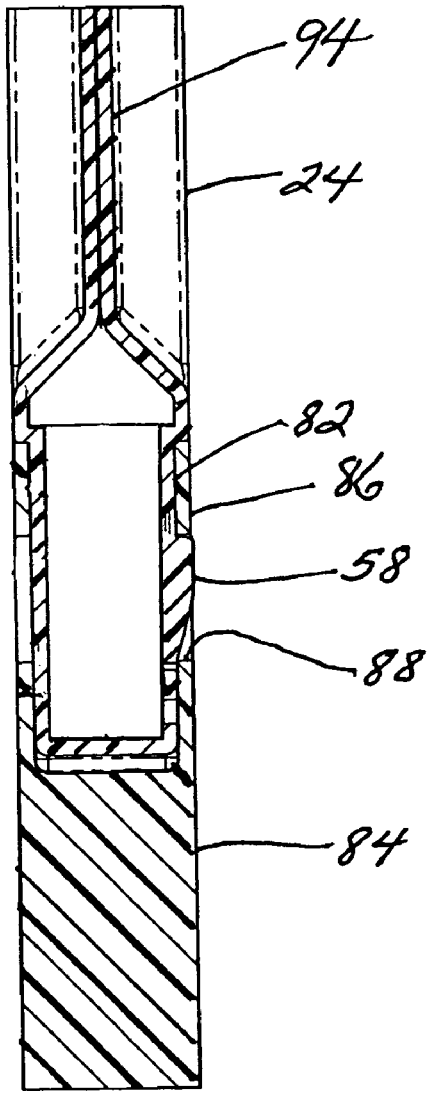
FIG. 8 is a section view in the direction of arrows 8-8 in FIG. 7.

The outer housing 20 is completely enclosed on the side panels, end panels, and top panel, while leaving the bottom margin 50 completely open. The inner housing 22 includes an enlarged in depth upper portion having generally parallel front and back sliding surfaces 38 and 62 and an enlarged in depth lower portion defining a ledge 52 as seen in FIGS. 5 and 8 which slidably receives and supports the open lower margin 50 of the outer housing 20. The main central portion of the inner housing is narrower in depth and rearwardly displaced as defined by front panel 44 and a back sliding panel 72. The outer housing 20 is slidably movable upwardly in the direction of arrow A with respect to the lower housing 22. Mating sliding surfaces 38/70, 62/(40, 98), and 72/98 serve to insure that the upward sliding movement of the outer housing 20 in the direction of arrow A (and then downward movement) is smooth and stable.

A display panel 46 is attached against the inner housing front panel 44 to display desired construction and advertising information while a name plaque 34 is attached against the outer housing front panel 60 by mechanical fastening means, the alignment margin 64 serving to protect the edges of the name plaque 34.

When the outer housing 20 is in the closed downward position, a closed, substantially water-tight interior volume V is defined into which construction documents, permits and the like shown generally at D, are protected. This interior volume V is defined between the recessed inner housing front panel 44 and the outer housing front panel 60. Because the entire outer surface of the outer housing 20 is watertight and formed as a unit of thermal plastic sheet material by the blow mold process, when the lower open margin 50 is slidably engaged against the L-shaped perimeter ledge 52 as best seen in FIG. 5, the entire interior volume V is substantially sealed and weather tight.

When the inner and outer housing 22 and 20, respectively, are in the closed position, a rearwardly extending upper locking rib 42 biasingly engages into an upper locking groove 28 formed along the upper back surface of the outer housing 20. This biased engagement is overcome by the lifting force exertable by grasping and upwardly lifting the outer housing 20 in the direction of arrow A. When upward movement of the outer housing 20 reaches its maximum open limit, a lower locking groove 26, formed adjacent the lower margin 50 of the outer housing 20, biasingly engages over the upper locking rib 42 to maintain this open orientation of the outer housing 20. Documents may then be placed into, or removed from, the now open interior volume V and resting atop surface 104 and held in place by the upright closed position of the retaining panel 36.

The documents D rest atop the rearwardly extending lower surface 104 of the inner housing 22 and typically and are held thusly by a document retaining panel 36 which forms a trough-like structure. After the outer housing 20 is slid upwardly in the direction of arrow A by either grasping the gripping ribs 30 or the lifting cap 32, the retaining panel 36, pivotally held about pivotal axis 74 by pivot shafts 100 at each lower end thereof, may be pivoted outwardly in the direction of arrow B in FIG. 8 to facilitate removal of these documents D. In the upright closed position, the retaining panel 36 is held thusly by the biased snapping engagement of the retaining tabs 102 as best seen in FIG. 6 into mating cavities formed into the upright side margins of the inner housing 22.

Figure 4:
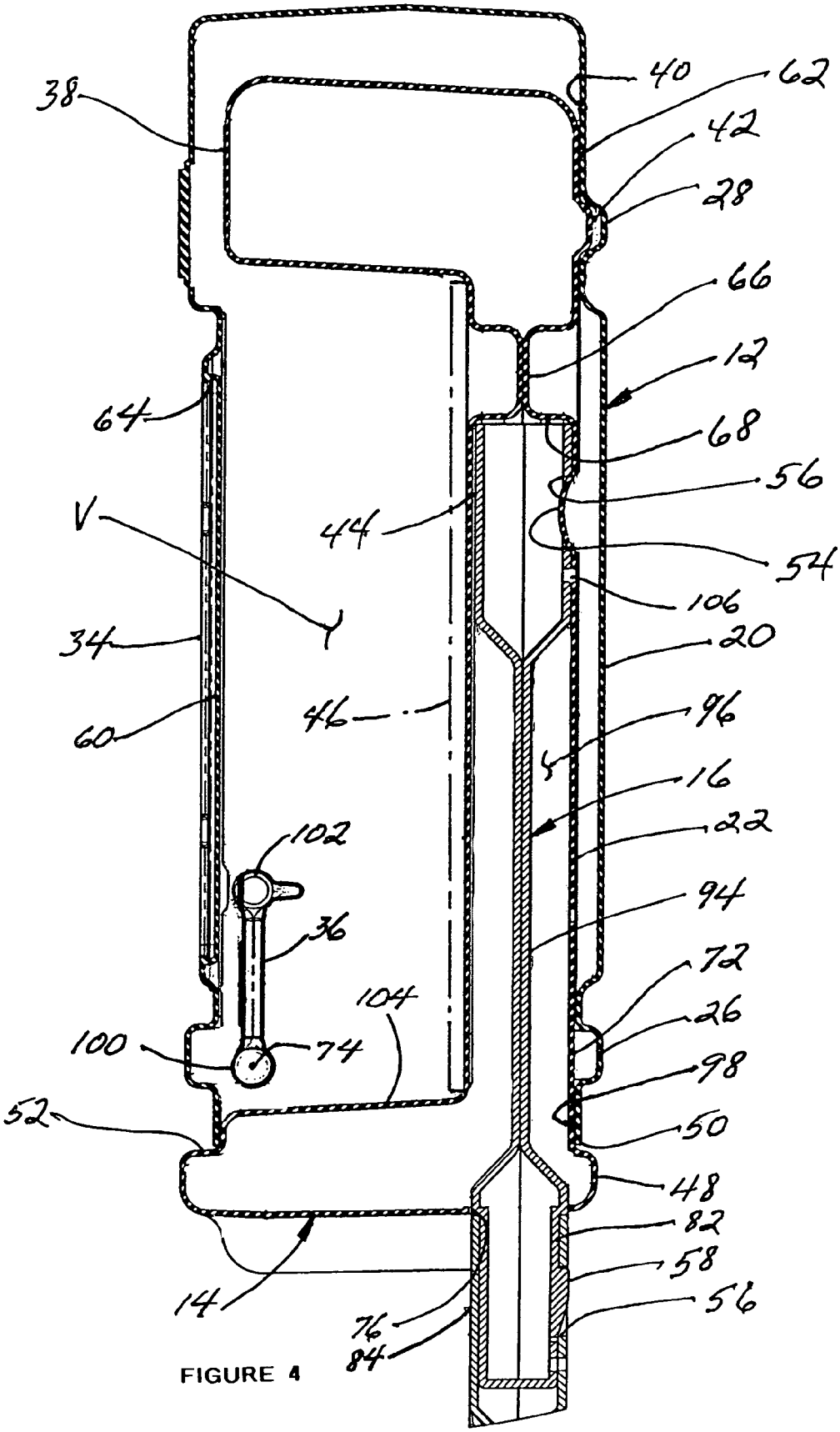
FIG. 4 is an enlargement of area 4 of FIG. 3.
Figure 11:
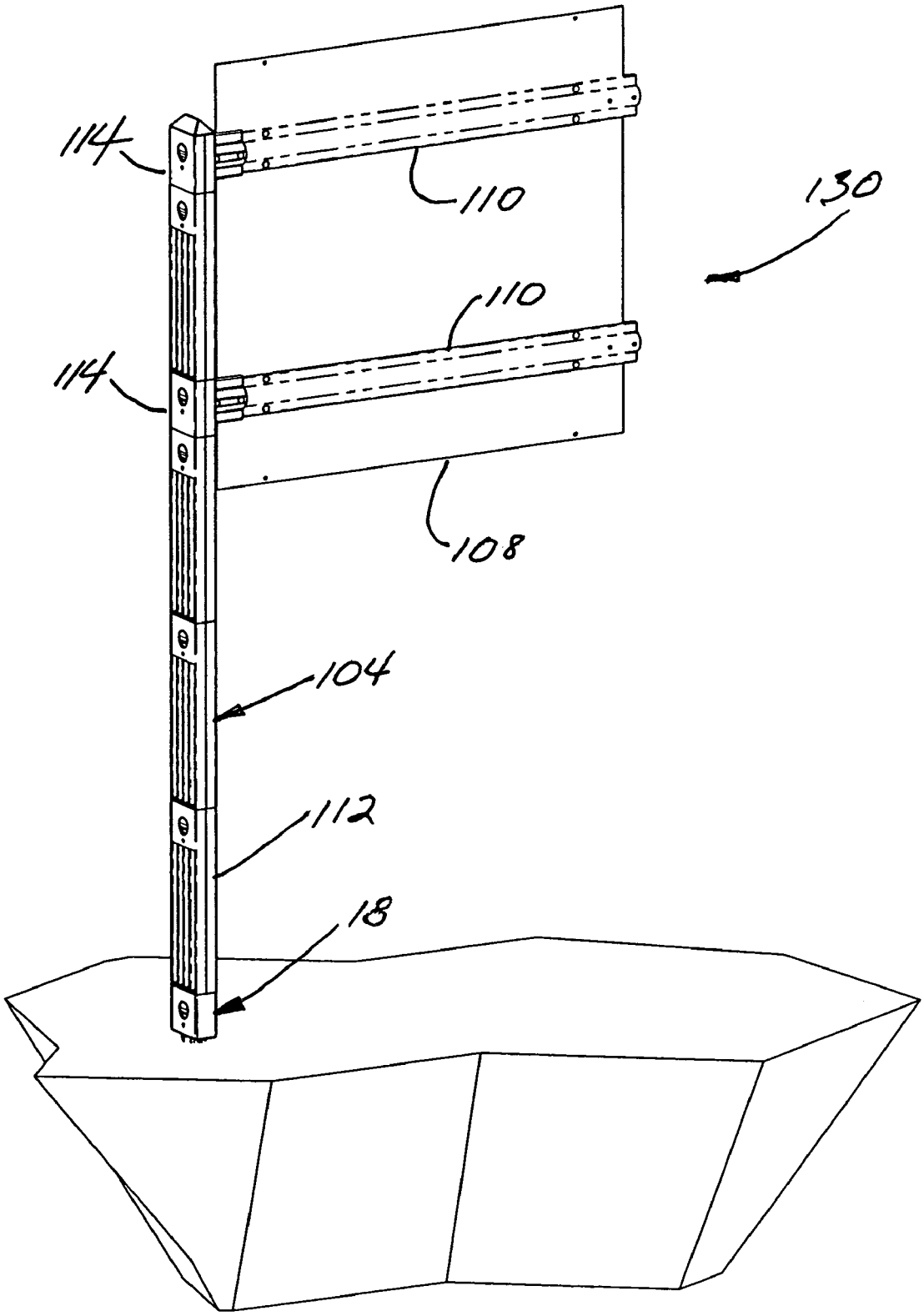
FIG. 11 is a perspective view of another embodiment of the combination stanchion assembly and real estate display sign.

An upper stanchion support cavity 96 as best seen in FIG. 4, is defined between the interior surfaces of the front panel 44 and the back sliding panel 72 of the inner housing 22. A stanchion receiving aperture 76 is formed into the bottom surface of the inner housing 22 in alignment with this cavity 96 so that the upper one of a plurality of stanchion sections 16 which are connected in end-to-end fashion as described herebelow, may be inserted upwardly thereinto. The top surface 68 of this support cavity 96 abuts against the upper end of the stanchion assembly 16 in concert with the biased interengagement which occurs between a resilient protruding retaining button 54 formed centrally into the back sliding panel 72 and a stanchion retaining aperture 56 formed centrally into the back sliding panel 72 and a stanchion retaining aperture 56 formed centrally adjacent the upper end of each of the stanchion sections 24 as best seen also in FIG. 11.

Each stanchion section 24 is also preferably formed of thin-walled thermoplastic material utilizing blow mold manufacturing techniques and includes a central web area 94 wherein the front and back panels are formed together and may be thermally bonded during the manufacturing process for additional strength therebetween. After the stanchion assembly 16 is secured in the position shown within support cavity 96, an additional retaining fastener aperture 106 is provided for installing a threaded fastener (not shown) to prevent removal of the stanchion assembly 16 therefrom.

The lower end 82 of each stanchion section 24 is reduced in size so as to matably engage into the hollow upper end 86 of the next stanchion section 24 and lockable engagement is effected by a locking tab 58 snapably engaging into the mating and aligned retaining aperture 56 of the next adjacent stanchion section 24.

Turning particularly to FIGS. 6 to 9, details of the ground-engaging tip 18 are there shown. This ground-engaging tip 18 is preferably mold formed of thermoplastic material and includes a hollow upwardly open upper end 86 having opposing aligned locking apertures 88 formed through the side walls thereof which lockingly engage with the locking tab 58 formed at the lower end of each stanchion section 24 as previously described. The main shaft 84 of ground-engaging tip 18 is ribbed for strength and economy of material. The lower end 90 is pointed for initial ground penetration which may be facilitated by stepping on the ground screw plate 92 or simply stepping on the upper end of the ground-engaging tip 18.

Figure 9:
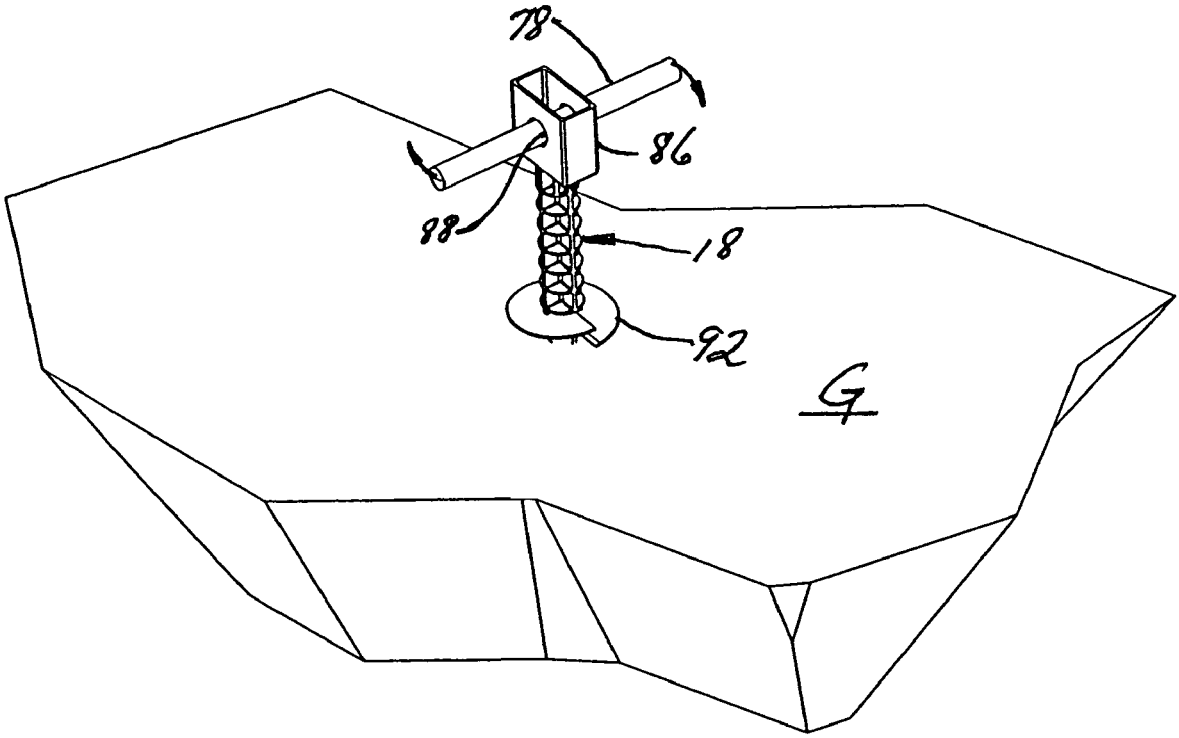
FIG. 9 is a perspective view of the ground-engaging lower tip section of the upright stanchion being set into the ground.

As best seen in FIG. 9, once the pointed tip 90 has penetrated into the ground sufficiently for the ground screw plate 92 to contact the ground, an elongated handle 78 may be temporarily inserted through the aligned locking apertures 88 and then hand-grasp to turn the ground engaging tip 18 in the direction of the arrows so as to cause the ground screw plate 92 to draw the ground-engaging tip 18 deeply into the ground for full, positive securement thereof. Thereafter, the desired number of stanchion sections 24 may be connected end-to-end as previously described to establish a proper viewing and use height for the entire storage apparatus 10.

Storage of the handle 78 is provided by snapping engagement into a mating handle storage cavity 80 formed into the back panel 72 of the inner housing 22 as best seen in FIG. 5.

Figure 10:
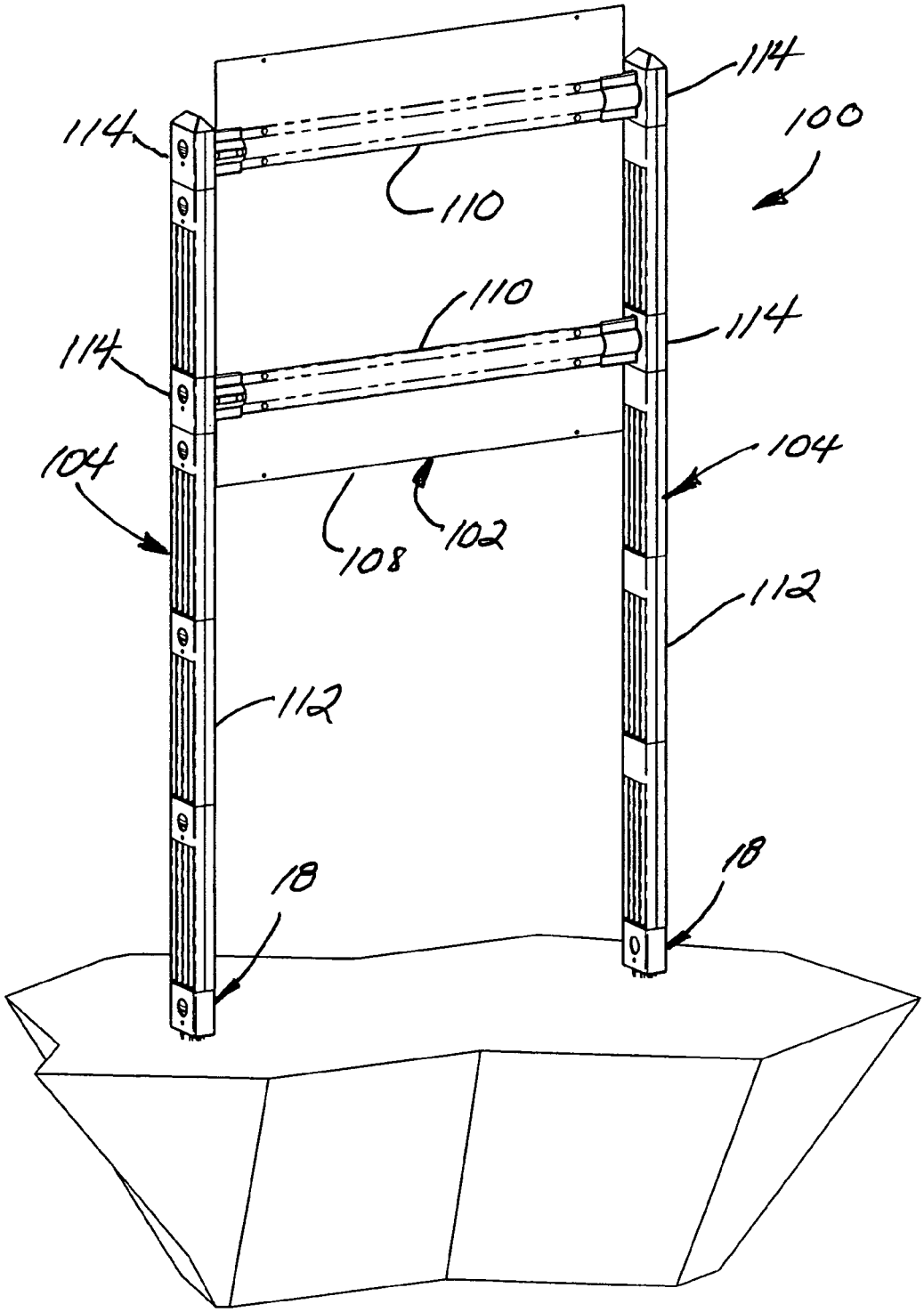
FIG. 10 is a perspective view of one embodiment of the combination stanchion assembly and real estate display sign.
Figure 12:
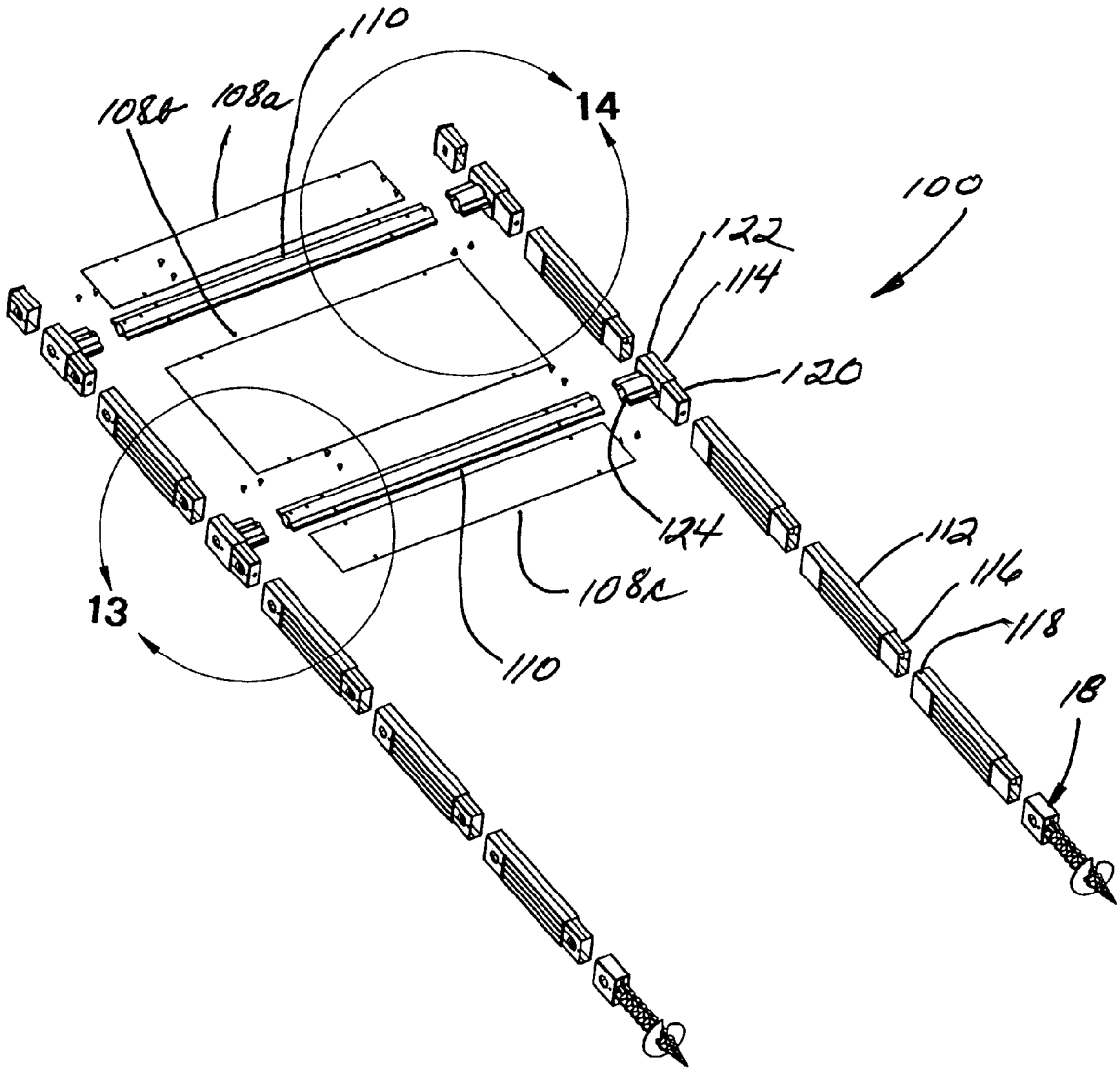
FIG. 12 is an exploded perspective view of FIG. 10.
Figure 13:
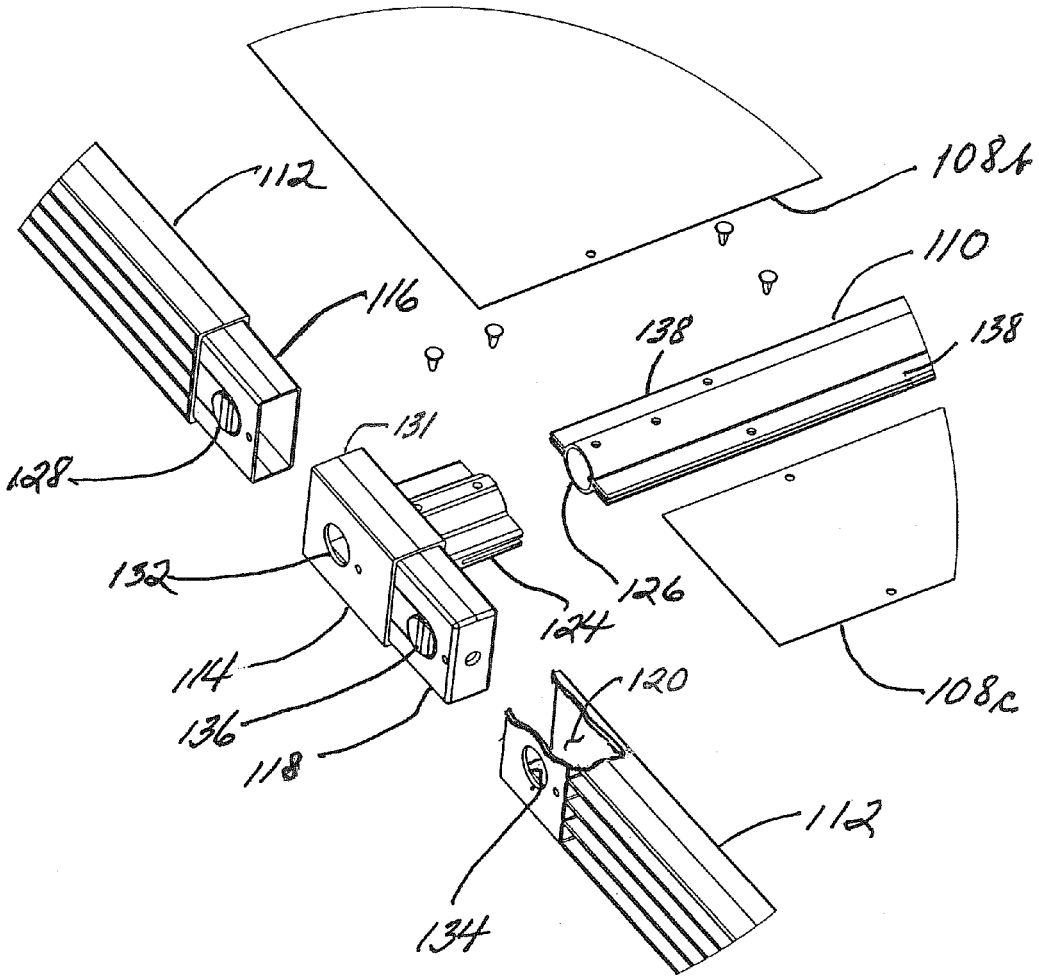
FIG. 13 is an enlargement of area 13 of FIG. 12.
Figure 14:
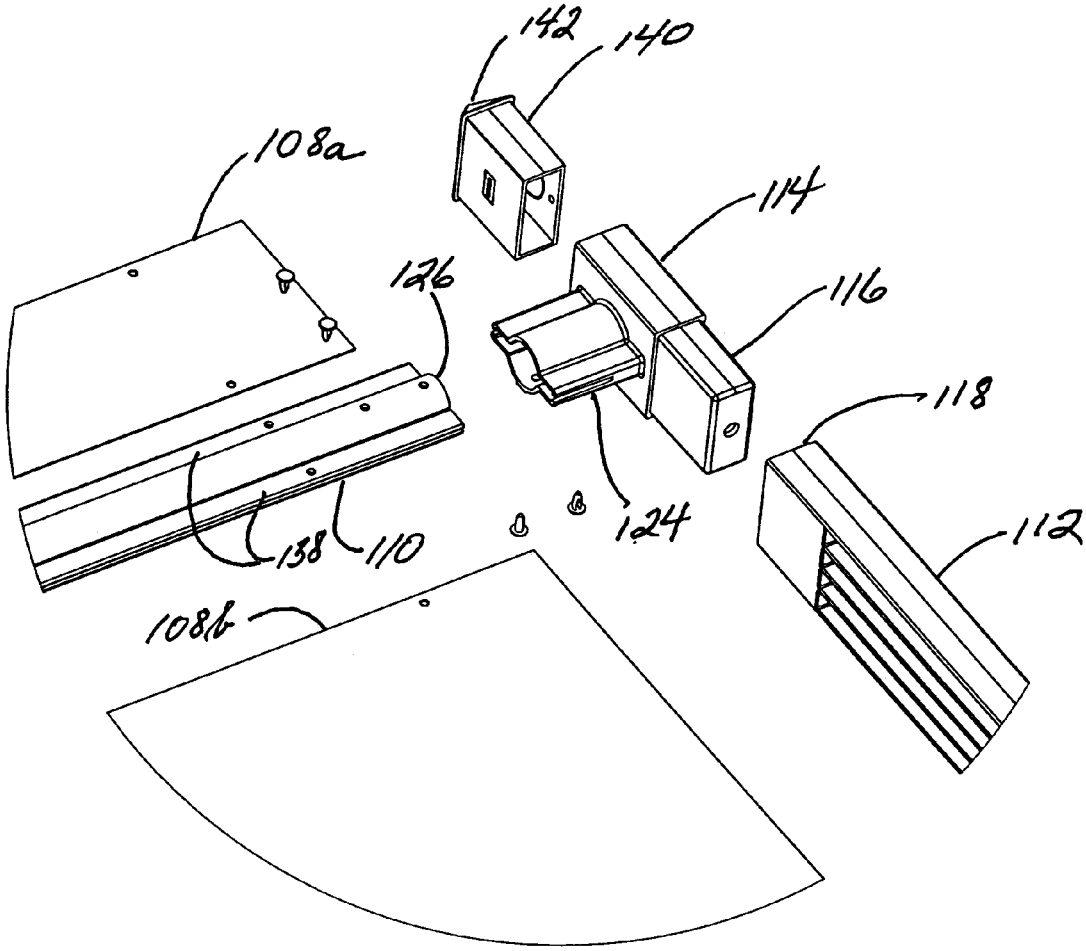
FIG. 14 is an enlargement of area 14 in FIG. 12.
Figure 15:
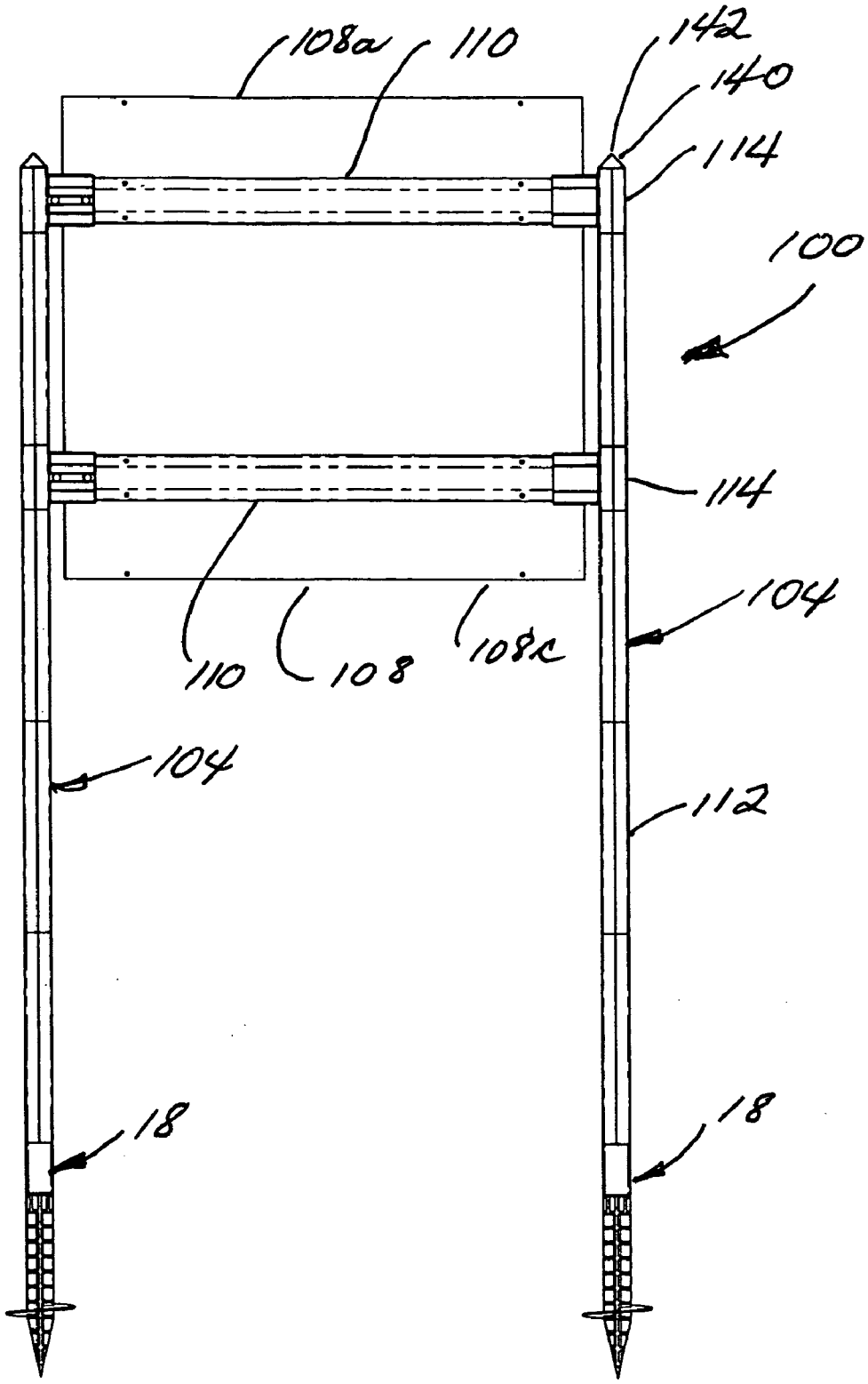
FIG. 15 is a side elevation view of FIG. 10.
Figure 16:
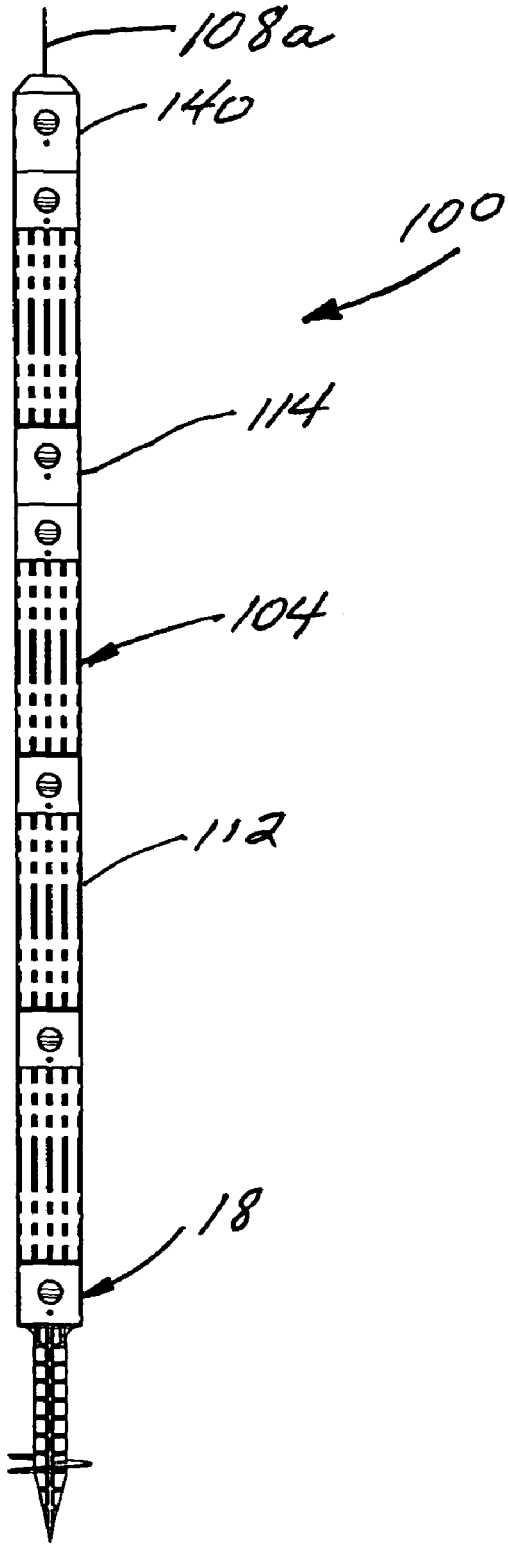
FIG. 16 is an end elevation view of FIG. 15.
Figure 17:
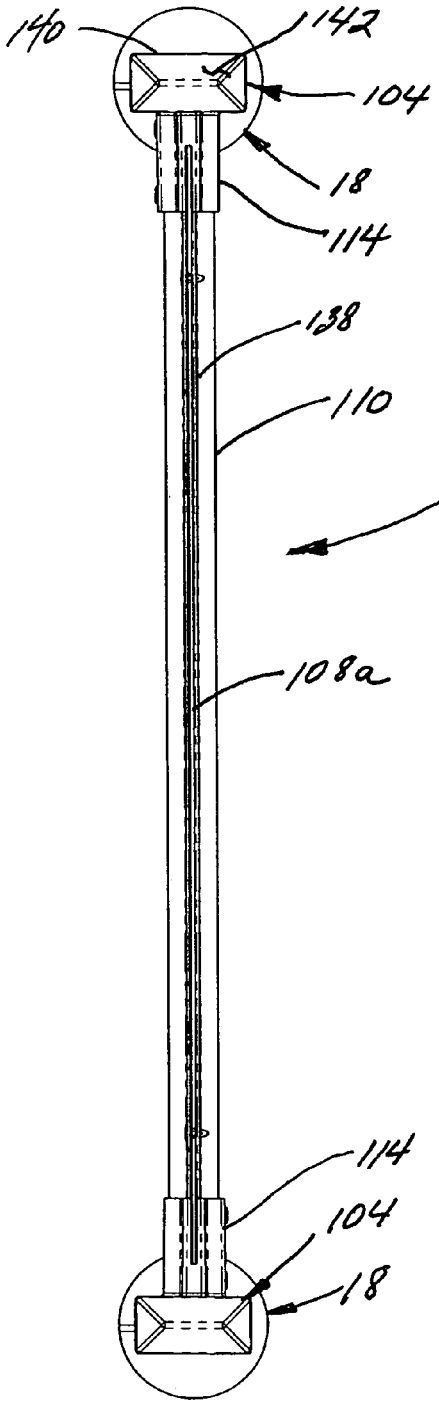
FIG. 17 is a top plan view of FIG. 15.
Figure 18:
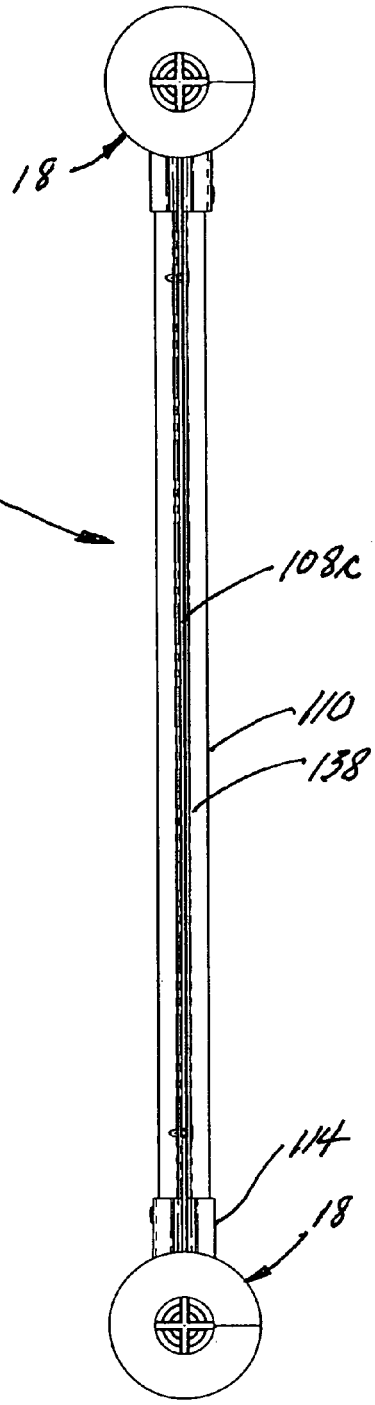
FIG. 18 is a bottom plan view of FIG. 15.

Referring now to FIGS. 10 to 18, two embodiments 100 and 130 utilizing the stanchion assembly 104 in combination with a real estate display sign 108 are there shown. In FIG. 10, two spaced upright stanchion assemblies 104, each of which include a plurality of substantially identical stanchion sections 112, a releasably and lockably connected in end-to-end fashion are there shown. This display sign assembly 100 also includes two vertically spaced horizontally disposed support arms 110 which are also releasably lockably connected at each end thereof as best seen in FIGS. 12 to 14 to a horizontal extension 124 of receiver 114. The receiver 114 includes a first end 131 being hollow which lockably engages onto a reduced size end 116 of one stanchion section 112. A biased locking pad 128 snapingly engages into mating aperture 132 to lockably secure that connection. A separate locking pad 136 of the reduced-in-size end 117 of the receiver 114 lockably engages into aperture 134 of the hollow end 120 of an immediately adjacent stanchion section 112. The orthogonally disposed extension 124 of the receiver 114 lockably engages over one end of the corresponding support arm 110, the arrangement being secured by fasteners shown in FIG. 12.

The display sign 108 is formed of display panels 108*a*, 108*b* and 108*c*. The main or central display panel 108*b* is connected by fasteners to opposing flanges 138 of the spaced support arms 110 shown in FIGS. 12, 13 and 14. Two smaller display panels 108*a* and 108*c* are connected to the outwardly facing flanges 138 of each of the support arms 110 to provide additional or enhanced display indicia for this real estate display assembly 100 in the form of such additional announcements as "sale pending", "swimming pool", "under contract", and "for lease" among others. By providing these separate smaller display panels 108*a* and 108*c*, the additional information suitable for the real estate display assemblies 100 or 130 may be easily connected or changed as appropriate.

The ground-engaging tips 18 are each structurally identical to those previously described. By suitable downward pressure and rotational motion, these ground-engaging tips 18 quickly and securely penetrate into the ground to support each of the stanchion assemblies 104. Locking engagement between the hollow upper end 86 with the reduced size lower end 116 of one of the stanchion sections 112, in combination with the biased locking pads 58 releasably engaging into apertures 88 of the ground-engaging tip 18, secures this junction or connection.

Each of the components of the stanchion assembly 104 are preferably formed by blow molding or injection molding plastic as desired so that the components are substantially water and weather resistant and retain the resilient integrity with respect to the locking pads to be repeatedly reusable. To finish the upper end of each of the stanchion assemblies 104, a top cap 140 is provided which lockably engages into the upper of the two receivers 114. Each of the top caps 140 includes a pyramid shaped top for decorative effect and for resisting water and snow penetration into the hollow interior of the hollow receiver 114.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A multi-section elongated stanchion assembly in combination with an exterior display sign comprising:

said stanchion assembly including:

a plurality of elongated substantially similar stanchion sections and a ground-engaging tip;

each of said stanchion sections including an elongated body having a hollow first end thereof and a second end thereof sized for slidable, releasable, lockable engagement into said first end of the next adjacent stanchion section of said stanchion assembly;

said ground-engaging tip being connected at a lower end of said stanchion assembly supporting said stanchion assembly in an upright position;

said display sign including:

a plurality of display panels bearing viewable information and a pair of spaced elongated display panel support arms;

one of said pair of support arms connected at one end thereof to a receiver connected into and between said first end of one of said stanchion section and said second end of the next adjacent stanchion section;

another one of said pair of support arms connected at one end thereof to another said receiver connected to a first end of an uppermost one of said stanchion sections;

one of said plurality of display panels connected to and extending between said support arms, each of two more of said plurality of display panels connected to and upwardly or downwardly, respective, extending from the upper or lower support arm, respectively.

2. An exterior real estate display sign comprising:

two spaced stanchion assemblies each of which includes:

a plurality of elongated substantially similar stanchion sections and a ground-engaging tip;

each of said stanchion sections including an elongated body having a hollow first end thereof and a second end thereof sized for slidable, releasable, lockable engagement into said first end of the next adjacent stanchion section of said stanchion assembly;

said ground-engaging tip being connected at a lower end of said stanchion assembly supporting said stanchion assembly in an upright position;

a plurality of display panels bearing viewable information and a pair of spaced elongated display panel support arms;

one of said pair of support arms connected at each end thereof to a receiver connected into and between said first end of one of said stanchion section and said second end of the next adjacent stanchion section of each of said stanchion assemblies;

another one of said pair of support arms connected at each end thereof to another said receiver connected to a first end of an uppermost one of said stanchion sections of each said stanchion assemblies;

one of said plurality of display panels connected to and extending between said support arms, each of two more of said plurality of display panels connected to and upwardly or downwardly, respective, extending from the upper or lower support arm, respectively.

* * * * *